United States Patent [19]

Cercone

[11] Patent Number: 4,526,016

[45] Date of Patent: Jul. 2, 1985

[54] RING AND SINGING DEVICE WITH PUSH TAB

[76] Inventor: Richard S. Cercone, 200 Dombey Dr., Pittsburgh, Pa. 15237

[21] Appl. No.: 519,362

[22] Filed: Aug. 1, 1983

[51] Int. Cl.[3] ..... A44C 9/02

[52] U.S. Cl. ..... 63/15.6

[58] Field of Search ..... 63/15.6, 15.7

[56] References Cited

U.S. PATENT DOCUMENTS

| | | | |
|---|---|---|---|
| 2,579,856 | 12/1951 | Pollard et al. | 63/15.6 |
| 3,465,544 | 9/1969 | Tucker | 63/15.6 |
| 3,518,843 | 7/1970 | Boening | 63/15.6 |
| 3,590,598 | 7/1971 | Leone | 63/15.6 |
| 4,215,556 | 8/1980 | Mroz | 63/15.6 |

FOREIGN PATENT DOCUMENTS

| | | | |
|---|---|---|---|
| 907191 | 6/1945 | France | 63/15.6 |
| 1434513 | 5/1976 | United Kingdom | 63/15.6 |

*Primary Examiner*—F. Barry Shay

*Attorney, Agent, or Firm*—Parmelee, Miller, Welsh & Kratz

[57] ABSTRACT

This invention relates to a finger ring adaptor device or bridge that will permit use by the wearer of a ring of a sufficient size to be easily slid over an enlarged knuckle or joint and to be thereafter reduced to a desired snug fit on the phalanx or digital portion of the finger.

2 Claims, 13 Drawing Figures

RING AND SINGING DEVICE WITH PUSH TAB

BACKGROUND OF THE INVENTION

There has been a serious problem, particularly from the standpoint of arthritics and older persons or persons that have knuckles that are relatively larger than the phalanx or digital portions of their hands that are to receive and carry a ring in a displaying position. If the ring is provided with a size enabling an easy movement over an enlarged knuckle, then it has a sloppy or flip-flop positioning on the phalanx portion such as to create considerable annoyance to the wearer and to present a problem from the standpoint of maintaining the setting in a firm, front viewing position.

Heretofore, an attempt has been made to solve this problem by using an enlarged ring size and then after it has been positioned on the phalanx, wrapping it with tape or thread to thus reduce its size to a suitable fit. However, this is unsightly, provides difficulty in effecting wrapping and requires frequent replacement.

Jewelers have endeavored to solve the problem by cutting through the back shank of the ring somewhat centrally to provide a ring with some enlarging flexibility for slide-on mounting on the finger of the wearer. The opposed cut end portions are provided with a sliding clasp for closing and latching the spacing when the ring reaches its final position on the phalanx. Such a form of catch or slide fastening results in a ridge or projection that is uncomfortable to the wearer. Also in many cases, the ring shank is not sufficiently flexible for the purpose intended. Providing a ring shank of wound flexible material is unsanitary, results in a shortened life of the shank portion, and has an objectionable feel to the wearer.

SUMMARY OF THE INVENTION

I have been able to primarily meet the problem involved by making use of a ring of a sufficient size to easily slide over the enlarged knuckle and then, in accordance with the invention, provide a semi-circular shaped bridge that can be thereafter moved into a secure, inside position around and within the back and side portions of the ring so as to reduce its diameter to a desired size for the finger phalanx. I was presented with the problem of how to construct and utilize such a bridge in order that it can be easily inserted and removed when it is desired to remove or reposition the ring and, at the same time, maintain its bridging position within the circular ring shank portion of the ring during normal wearing conditions and without an objectionable "feel" to the wearer. A further important factor has been the need to provide a bridge that will be relatively inexpensive to produce and that can be provided in various sizes for ready adaptation to the wearer's requirements. Heretofore, the above described cut-out type of construction or adaptation of a ring required craftsman work that has been very expensive to the ring owner.

In one embodiment of my invention I have provided a removable and in a second embodiment I have provided a hinged bridge which can be easily mounted by a jeweler on a conventional ring and which will be a more refined and stable type of mounting from the standpoint that the bridge is, itself, hingedly attached to the ring shank, but in such a manner as to avoid a localized ridge or offset that will be uncomfortable to the wearer's finger. The latter construction is also so devised as to provide a one piece ring-adaptor unit, and of a type that will not damage the ring shank, will be substantially invisible when the ring is being worn, and will be so constructed that it can be easily swung into a substantially locked wearing position after the ring has been slid over the enlarged knuckle onto the finger phalanx.

Figure 5:
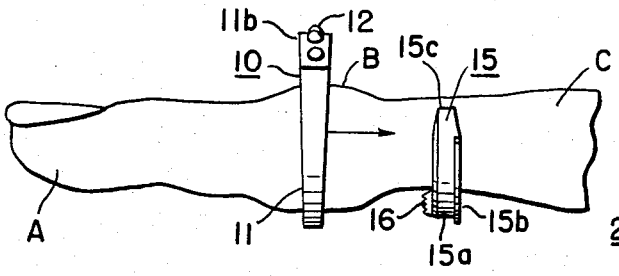
FIG. 5 is a somewhat diagrammatic view illustrating how the ring shown in FIG. 2 is slid from the index portion of the finger over an enlarged knuckle onto the wearer's phalanx and thus into a receiving position for the bridge device or element; the bridge device in this view has the correct position for the final mounting to provide a composite assembly.
Figure 6:
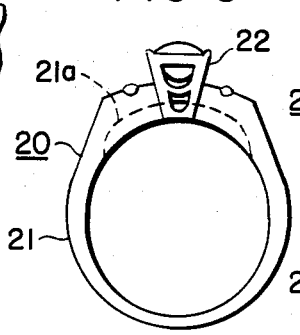
FIG. 6 is a top plan view of a ring employed in a second or unitary type of embodiment of the invention in which the bridging device is hingedly mounted on the central location of the ring shank.
Figure 9:
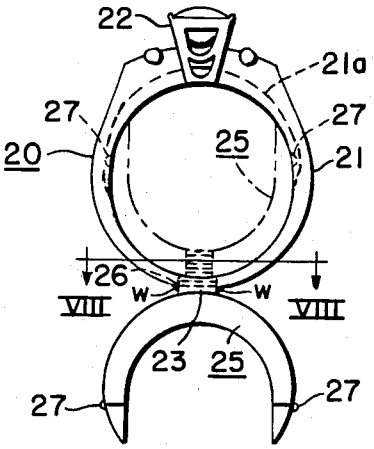
FIG. 9 is a top plan view of the ring of FIG. 7 having the bridge part of FIG. 8 in a final mounted and secured position thereon.
Figure 12:
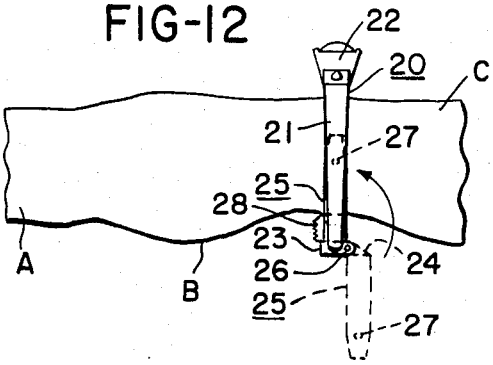

And, FIG. 12 is a view similar to FIG. 5 but which illustrates the mounting of the composite ring of FIG. 9 on the finger of the wearer.

DESCRIPTION OF THE PREFERRED EMBODIMENTS

Referring particularly to FIGS. 1 to 5, inclusive, a ring 10 of conventional construction is shown having a circular banding or shank portion 11 and a front mounting crest portion **11*b*. Conventionally, stone settings such as 12, may be inserted in the crown portion 11*b*** which thus represents the portion of the ring which is to face outwardlly of the finger of the wearer for comfort and for display.

As indicated a lady's ring 10 may have a groove portion **10*a* which extends from opposite central side portions thereof along the crest portion 11*b***. This is not essential, however, to the employment of a bridge device such as illustrated in FIGS. 3 and 4.

As shown in FIG. 5, the ring 10 is, in accordance with the invention, provided with an enlarged size selected on the basis of the size of the wearer's enlarged knuckle B. It may be conventionally of about two sizes larger than required for a snug, comfortable wearing fit on a phalanx, terminating or hand connected portion C of a finger. The ring 10 is slid, as shown by the arrow of FIG. 5, from the index portion A over the knuckle B and into a final mounted relation within a half moon shaped adaptor element or bridge device 15 of the invention.

Figure 1:
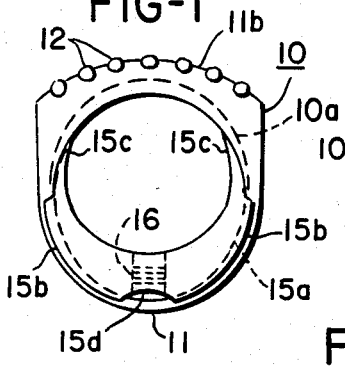
FIG. 1 is a bottom plan view of a conventional ring showing a removable adaptor device or bridge element of the invention in finger wearing position therein; this view shows the construction as it will appear looking outwardly from the hand towards the end of the finger.
Figure 2:
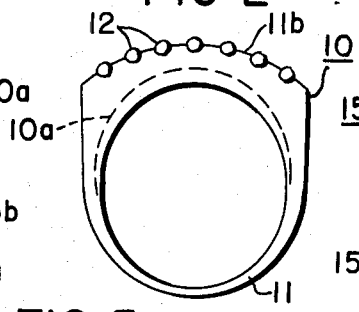
FIG. 2 is a plan view of the ring with the adaptor bridge element removed.
Figure 3:
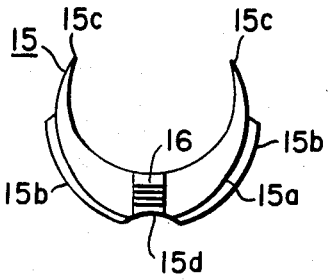
FIG. 3 is a top plan view of the adaptor element or bridge device when removed from the mounted position of FIG. 1 within a ring shank.
Figure 4:
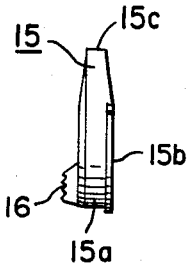
FIG. 4 is a side view in elevation of the device or element of FIG. 3.

With particular reference to FIGS. 3, 4 and 5, the adaptor device 15 is shown provided with a sloped, smoothly rounded main body 15*a*. The body 15*a* on its inside is substantially semi-circular in shape so as to form a continuation of the circular shank 11 ring 10 with which it is to be used as an inside mounting within a half portion thereof. Its smoothly sloped, rounded body 15*a* terminates on one side pair of slightly projecting, opposite side flanges 15*b*, and has a centrally located, back-positioned entry slot 15*d* which is shown in alignment with a projecting, knurled push tab 16 on the opposite side of its body. As indicated in FIG. 5, when the ring 10 and its shank 11 have been moved to a final wearing position, the flange 15*b* of the bridge 15 will engage against the inside side face of the ring band in smooth abutment therewith, while the smoothly curved side 15*a* and the push removal tab 16 face outwardly of the ring band and towards the tip or front end A of the finger on which the ring is mounted.

The arrangement is such that normal wearing of the composite assembly on the finger phalanx C will tend to retain the bridge 15 in its inside, size-reducing position within the back half of the ring shank or its band 11 to provide a comfortable and a desired snug fit of reduced diameter for the particular size of the finger phalanx C. This half moon insert device or element 15 can be made of any suitable material, such as metal or plastic (resin) material, and a jeweler can provide sizes from, for example, 2 through 16, to fit any size ring and provide any size of fitting as required in view of the wearer's size of enlarged knuckle B and ring-receiving phalanx C. Thus, a very practical, inexpensive and highly satisfactory type of size adaptation is accomplished without in any way altering the construction of the ring.

Figure 10:
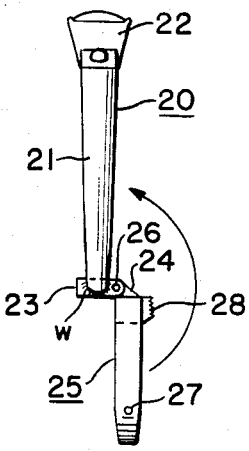
FIG. 10 is a side view in elevation of the composite ring construction of FIG. 8 showing by an arrow how the shank is closed to provide the desired finger-fitting relation on the phalanx of the wearer; this closing action is from the back underside portion or the palm side of the finger.
Figure 11:
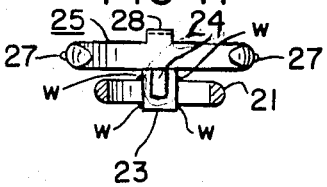
FIG. 11 is a sectional view on the scale of and taken along the line VIII—VIII of FIG. 9.
Figure 8:
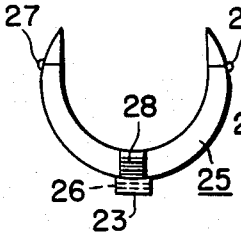
FIG. 8 is a top plan view and FIG. 8A is a side view of a bridge part that is to be mounted between cut-off opposed ends of the shank of the ring shown in FIG. 7.
Figure 8A:
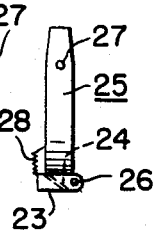

In the embodiment shown in FIGS. 9 to 11, inclusive, the circular ring body, band or shank 21 of the ring 20 also conventionally has a slight centrally located inner groove 21*a* and crown 22. In this embodiment, a bridge 25, preferably of metal of the same type as the ring 20, is provided with a 180° swingable hinge fit on a central back portion of the shank 21. As shown, the bridge 25 is provided with a slightly projecting hinge having a tongue portion 23 that has a bifurcated portion 24 pivotally mounted thereon by a pin 26 in such a manner that the bridge can only be swung downwardly-outwardly and backwardly when the hinge is mounted on the ring shank or body 21. See the arrow of FIG. 10. A pair of radially outwardly extending, oppositely positioned tabs or dimples 27 are secured to extend from the outer side arms of the bridge 25 for inside snap into the groove 21*a* to normally retain the bridge 25 when it is moved from an open or outside horizontal position of FIG. 9 to an inside swung position, as indicated by the arrows of FIGS. 10 and 12. The tabs 27 abut the inside of the ring shank 21 when the ring 20 is being carried on the phalanx C of the finger of the wearer (see FIG. 12). The construction is such that the bridge 25 cannot be moved upwardly through the ring 20 on its hinge, but can only be swung 180° from an outward horizontal position downwardly to a vertical position and then to a front, ring-inserted, horizontal, finger mounting position on the finger phalanx C (see FIG. 9). An upper face of the bridge part 25 has a push tab or knurled portion 28 in a central or middle location thereon and in an aligned relation with respect to the hinge. The tab 28 facilitates a "down" push on the semi-circular bridge 25 to open it with respect to the ring 20.

Figure 7:
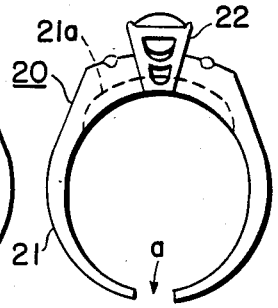
FIG. 7 is a top plan view of the ring of FIG. 6 illustrating a first step in adapting it to receive and mount a hinge part of a bridge part thereon.

A single and inexpensive procedure is involved in making the composite structure of FIGS. 9 and 10. First, the purchaser selects the style and setting of the ring 20 from the jeweler's display. The jeweler then cuts out a small piece of the shank 21, as shown in FIG. 7, to provide a slight mounting space a between exposed, opposed ends of the shank. The jeweler measures the size of the knuckle B of the finger on which the ring is to be worn and provides a ring shank of an appropriate size for sliding thereover. This may, for example, be one or two sizes larger than the desired size for a suitable snug or wearing fit on the finger phalanx C.

The jeweler then selects a size of bridge part 25 from his sized stock which, when mounted on the ring 20, will provide a desired fit on the purchaser's finger phalanx C. He follows this by inserting the projecting hinge of the selected bridge 25 in the space a (see FIG. 7) and welding, soldering, brazing or cementing it securely in place between opposed ends of the ring shank 21. This provides a composite structure that does not detract from the appearance of the ring and when worn is substantially invisible to others viewing the ring. The bridge mounting is such that it will be retained within the circular ring shank as a substantially unitary, hidden, size-reducing, semi-circular back, inner part thereof. The invention also enables the jeweler to easily adapt a customer's own ring by cutting and enlarging its shank sufficiently to easily slide over the customer's finger knuckle, and then selecting the mounting a suitable semi-circular bridge of the invention to reduce the ring wearing diameter to an appropriate size.

I claim:

1. An improved ring sizing assembly of a quickly and fully separable construction for use by a wearer in retaining a ring on his or her finger phalanx which comprises, a substantially circular ring shank of a larger than a desired wearing size that is to be slid over a finger knuckle for mounting on the finger phalanx, a substantially semi-circular size-reducing bridge part that is easily insertable and completely removable from a secure frictional fitting relation within said ring shank by the wearer from a finger phalanx wearing position therein by manual pushing in-and-out force applied thereto, said bridge part having a connecting back portion and a pair of opposed prong portions of a shape and size to be frictionally secured in alignment within an encircling back portion of said ring shank, said bridge part having means including flange portions along one side face thereof of a diameter larger than the inside diameter of an inner receiving portion of said ring shank to limit insertion and removal of said bridge part from the one side face of the ring shank and to provide it with a mounted positioning within said ring shank, a push tab projecting outwardly from an opposite side face of said bridge part substantially centrally of its said connecting back portion and also projecting outwardly beyond an adjacent side of said ring shank when said bridge part is in a fully mounted position therein, said bridge part being adapted to be pushed by an application of manual pressure force applied to said flange portions of its one side face into an inside-mounted size-reducing relation within substantially a back half of said ring shank after said ring shank has been slid over the knuckle to the finger phalanx, and said bridge part being adapted to be removed from and out of its size-reducing mounted position within said ring shank by an application of manual pressure force to said push tab when said ring shank is to be slid off the wearer's finger.

2. A ring sizing assembly as defined in claim 1 wherein said bridge part is of resilient material.

* * * * *